US011623442B2

(12) United States Patent
Toshishige

(10) Patent No.: US 11,623,442 B2
(45) Date of Patent: Apr. 11, 2023

(54) SUBSTRATE, LIQUID EJECTION HEAD, AND METHOD OF MANUFACTURING SUBSTRATE

(71) Applicant: CANON KABUSHIKI KAISHA, Tokyo (JP)

(72) Inventor: Mitsunori Toshishige, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 87 days.

(21) Appl. No.: 17/377,853

(22) Filed: Jul. 16, 2021

(65) Prior Publication Data

US 2022/0032620 A1 Feb. 3, 2022

(30) Foreign Application Priority Data

Jul. 30, 2020 (JP) ..... JP2020-129242

(51) Int. Cl.
*B41J 2/14* (2006.01)
*B41J 2/16* (2006.01)

(52) U.S. Cl.
CPC ..... *B41J 2/14145* (2013.01); *B41J 2/1601* (2013.01); *B41J 2/1626* (2013.01)

(58) Field of Classification Search
CPC .... B41J 2/14145; B41J 2/1601; B41J 2/1626; B41J 2/1623; B41J 2/1628; B41J 2/1629; B41J 2/1631; B41J 2/1632; B41J 2/1634; B41J 2/1603
See application file for complete search history.

(56) References Cited

U.S. PATENT DOCUMENTS 6,908,564 B2 6/2005 Koyama et al.
2003/0197763 A1 10/2003 Koyama et al.
2014/0340451 A1* 11/2014 Hasegawa ..... B41J 2/14024 347/54

FOREIGN PATENT DOCUMENTS

JP 2003-311982 A 11/2003

OTHER PUBLICATIONS

IP.com search #1 (Year: 2022).*
IP.com search #2 (Year: 2022).*

* cited by examiner

*Primary Examiner* — Lisa Solomon
(74) *Attorney, Agent, or Firm* — Venable LLP

(57) ABSTRACT

In a substrate, a first flow channel opened in a first surface of a silicon base material having a crystal orientation of <110>, and a second flow channel opened in a second surface of the silicon base material opposite the first surface are formed to communicate with each other. The second flow channel has an opening width narrower than an opening width of the first flow channel, and a groove portion shallower than a depth of the second flow channel is formed close to the opening of the second flow channel in a region that is inside the opening of the first flow channel and outside the opening of the second flow channel in the second surface.

19 Claims, 11 Drawing Sheets

SUBSTRATE, LIQUID EJECTION HEAD, AND METHOD OF MANUFACTURING SUBSTRATE

BACKGROUND OF THE INVENTION

Field of the Invention

The present disclosure relates to a substrate in which a flow channel is formed, a substrate for a liquid ejection head, the liquid ejection head, and a method of manufacturing the substrates.

Description of the Related Art

One of liquid ejection heads ejecting liquid such as ink from ejection ports includes multiple supply flow channels that are formed penetrating a substrate including an ejection energy generation element to supply the liquid to the ejection ports.

Japanese Patent Laid-Open No. 2003-311982 discloses a method of manufacturing a substrate used for the above-described liquid ejection head. In this manufacturing method, supply flow channels of different opening widths are formed by: forming mask patterns by patterning thermal oxide films formed on two surfaces of a silicon substrate having a crystal orientation of <110>; and performing crystal anisotropic etching on the two surfaces of the silicon substrate concurrently.

SUMMARY OF THE INVENTION

The present disclosure is a substrate in which a first flow channel opened in a first surface of a silicon substrate having a crystal orientation of <110>, and a second flow channel opened in a second surface of the silicon substrate opposite the first surface are formed to communicate with each other. The second flow channel has an opening width narrower than an opening width of the first flow channel, and a groove portion shallower than a depth of the second flow channel is formed close to the opening of the second flow channel in a region that is inside the opening of the first flow channel and outside the opening of the second flow channel in the second surface.

Further features of the present invention will become apparent from the following description of exemplary embodiments with reference to the attached drawings.

DESCRIPTION OF THE EMBODIMENTS

In a case where supply flow channels are formed from two surfaces of a silicon substrate as described in Japanese Patent Laid-Open No. 2003-311982, immediately after the supply flow channels communicate with each other, a plane (111) in which the etching rate is slow cannot be maintained in a communication portion of the supply flow channels, and there occurs a phenomenon that openings of the supply flow channels disintegrate gradually. If an opening of a supply flow channel having a narrow opening width exceeds a tolerance and disintegrates, the substrate becomes a defective item. However, even in the case where the defection occurs, if the variation in the opening shape of the supply flow channel is small, there are required precise shape examination, dimension measurement, and the like by an accurate examination apparatus for the quality determination on the substrate.

The present disclosure provides a technique that allows for easy determination on the quality of a flow channel formed in a substrate.

Hereinafter, embodiments of the present disclosure are described with reference to the drawings. The embodiments are described while adopting a substrate fora liquid ejection head, which is used in the liquid ejection head, as an example of a substrate that is a silicon substrate in which a flow channel through which liquid can flow is formed. The liquid ejection head described in the embodiments is applicable to not only a printer and a copier but also to a fax with communication system, a word processor or a portable device with printer unit, an industrial apparatus compositely combined with various processing devices, and the like. Additionally, the liquid ejection head in the embodiments can also be applied to a molding device such as three dimensional printer, a semiconductor manufacturing device, a medical device, and the like. A target to which the liquid is ejected may be either a two dimensional structure or a three dimensional structure, or the liquid may be ejected to a space. The liquid used in the embodiments is ink for printing; however, the liquid to be ejected is not particularly limited.

First Embodiment

Figure 1:
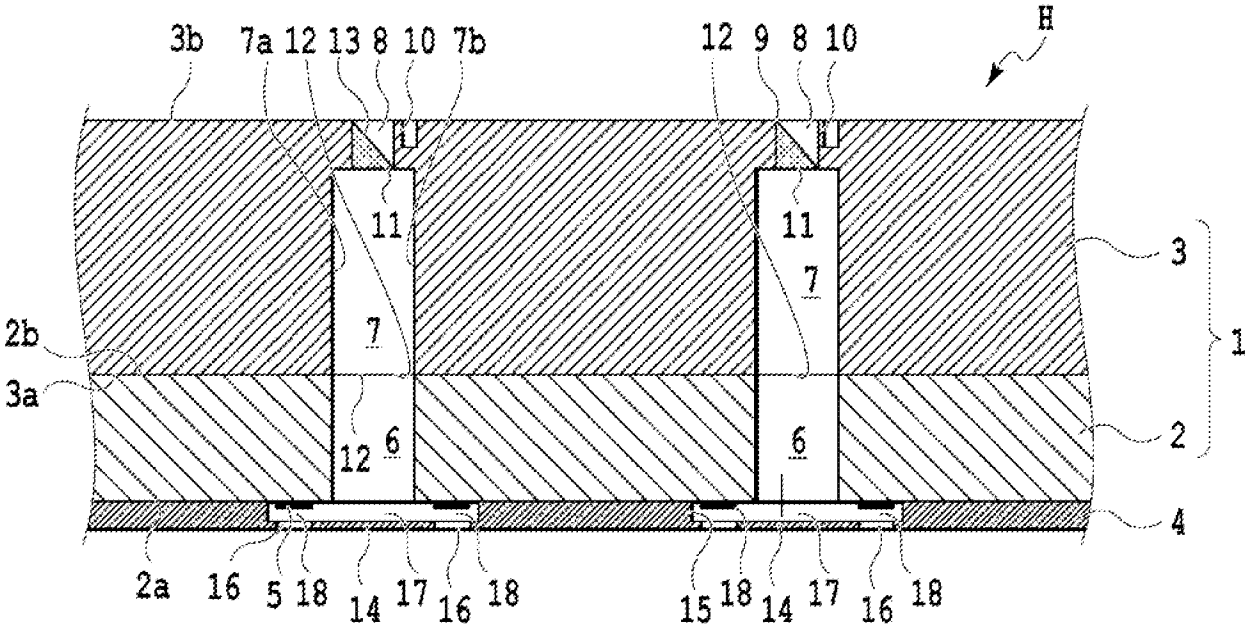
FIG. 1 is a schematic cross-sectional view illustrating a part of a liquid ejection head in a first embodiment.
Figure 2:
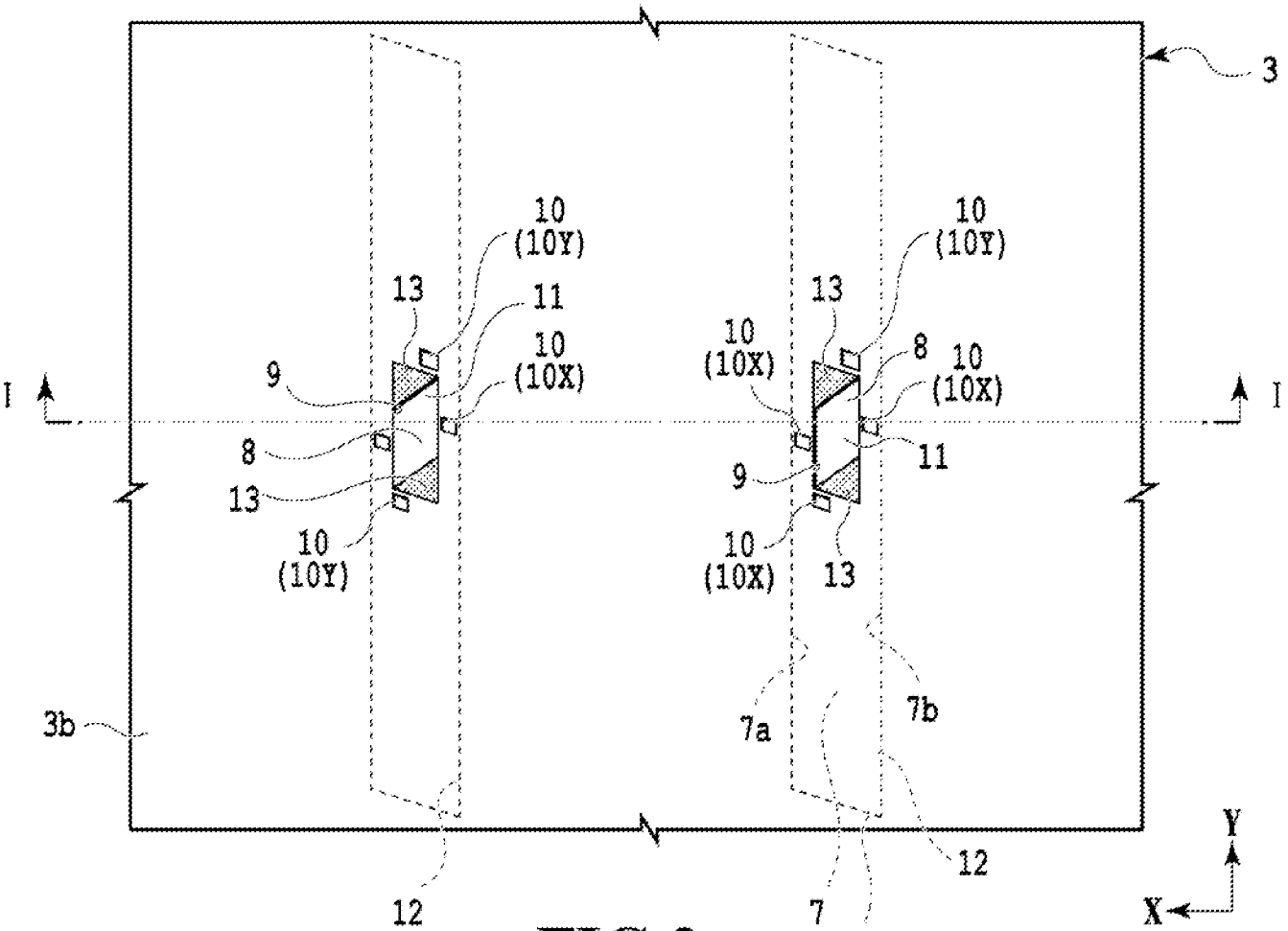
FIG. 2 is a schematic plan view of the liquid ejection head illustrated in FIG. 1.

FIG. 1 is a schematic cross-sectional view illustrating a part of a liquid ejection head H in a first embodiment of the present disclosure, and FIG. 2 is a schematic plan view of the liquid ejection head H illustrated in FIG. 1. In FIG. 2, for the sake of convenience, later-described constituents illustrated in FIG. 1, that is, a second substrate 3, a second supply flow channel 7, a third supply flow channel 8, a groove portion 10, and an inclined portion 13 are illustrated on the same plane. Additionally, in FIG. 2, for the sake of convenience, a first substrate 2, electric structures such as wiring and a driving circuit formed on the first substrate 2, and an adhesive thereon are not illustrated.

The liquid ejection head H includes a substrate 1 for a liquid ejection head (hereinafter, referred to as a substrate 1 for the head) and a flow channel formation member 4. The substrate 1 for the head includes a first substrate 2 and the second substrate 3 adhered to a back surface (upper surface in FIG. 1) 2*b* of the first substrate 2, and the flow channel formation member 4 is provided on a front surface (lower surface in FIG. 1) 2*a* of the first substrate 2.

On the front surface 2*a* of the first substrate 2, not only an ejection energy generation element (hereinafter, referred to as an ejection element) 5 that generates ejection energy for ejecting the ink but also electric structures such as a driving circuit of the ejection element 5 (not illustrated), wiring, and a connection element (not illustrated) are formed. The ejection element 5 may be a heating resistance element using a TaSiN film, for example. The ejection element 5 in this embodiment includes an electric-thermal conversion element that generates thermal energy as the energy for ejecting the liquid. The number of the ejection element 5 is not limited, and multiple ejection elements 5 may be arranged at predetermined intervals. On the first substrate 2, an insulation layer, a protection layer, an adhesion improvement layer, flattening layer, an antireflective layer, a chemical-resistant layer, and so on may be formed (these layers are not illustrated). These layers may be formed between arbitrary layers. The driving circuit includes a semiconductor element such as a transistor. Material of the first substrate 2 is not particularly limited as long as a semiconductor element and a circuit can be formed thereon; however, it is favorable to use a silicon substrate (silicon base material) in terms of controllability of resistivity and workability.

In the descriptions below, the front surface of the first substrate 2 on which the ejection element 5, the driving circuit (not illustrated), wiring, a connection terminal (not illustrated), and the like are formed is referred to as a first surface 2*a*, and the back surface positioned opposite the first surface 2*a* is referred to as a second surface 2*b*. In the second substrate 3, a front surface (lower surface in FIG. 1) in contact with the second surface 2*b* of the first substrate 2 is referred to as a first surface 3*a*, and a back surface (upper surface in FIG. 1) positioned opposite the first surface 3*a* is referred to as a second surface 3*b*.

In the first substrate 2, a first supply flow channel 6 to which the ink is supplied is formed so as to penetrate the first substrate 2 from the first surface 2*a* to the second surface 2*b*. The first supply flow channel 6 is formed between the ejection elements 5 adjacent to each other.

In the second substrate 3, the second supply flow channel 7 that supplies the ink to the first supply flow channel 6 is formed. The second supply flow channel 7 is formed along a Y direction (first direction). In the second substrate 3, the third supply flow channel 8 that supplies the ink to the second supply flow channel 7 is formed. The second supply flow channel 7 is opened in the first surface 3*a* of the second substrate 3, and this opening is referred to as a second supply flow channel opening 12. The third supply flow channel 8 is opened in the second surface 3*b* of the second substrate 3, and this opening is referred to as a third supply flow channel opening 9. The second supply flow channel 7 and the third supply flow channel 8 communicate with each other, and the portion in which the communication is made is referred to as a communication portion 11.

In a case where the second supply flow channel 7 extending in a direction orthogonal to the two surfaces (the first surface 3*a* and the second surface 3*b*) of the second substrate 3 is formed by anisotropic wet etching, it is favorable to use a silicon substrate (silicon base material) having a crystal orientation of <110> as the second substrate in terms of workability.

As illustrated in FIG. 2, the opening shape of the second supply flow channel opening 12 and the third supply flow channel opening 9 in this embodiment is parallelogram. Two long sides of the second supply flow channel opening 12 forming the parallelogram are formed of end portions of right and left side surfaces 7*a* and 7*b* of the second supply flow channel 7 and extend in the Y direction. The opening shape of the second supply flow channel opening 12 and the third supply flow channel opening 9 is not limited to the illustrated shape and may be any of square, rectangle, polygon, and circle. However, in a case where a silicon substrate having a crystal orientation of <110> is used for forming the second substrate by anisotropic wet etching, it is preferable to form the opening shape of the second supply flow channel opening 12 and the third supply flow channel opening 9 in parallelogram, which allows for easy control of the etching shape in the plane (111). In the case where the etching shape is controlled, it is favorable that interior angles of the parallelogram have an acute angle of about 70.6° and an obtuse angle of about 109.4°.

In this embodiment, in a case where the third supply flow channel opening 9 exceeds a tolerance (upper limit value of error) and disintegrates, the disintegration is expanded to increase the variation in the opening shape so as to make the quality determination on the substrate easy. In this case, it is favorable to form the opening width of the third supply flow channel opening 9 in an X direction narrower than the opening width of the second supply flow channel opening 12 in the X direction. This is because, if the width of the third supply flow channel opening 9 in the X direction is greater than the width of the second supply flow channel opening 12 in the X direction, the shape of the second supply flow channel opening 12 follows the shape of the third supply flow channel opening 9 in the second substrate 3 that is a silicon substrate having a crystal orientation of <110>, and the third supply flow channel opening 9 does not disintegrate.

On the second substrate 3, an insulation layer, a protection layer, an adhesion improvement layer, a flattening layer, an antireflective layer, a chemical-resistant layer, and the like (these layers are not illustrated) may be formed, and these layers may be formed between arbitrary layers. The second surface 2*b* of the first substrate 2 and the first surface 3*a* of the second substrate 3 are adhered to each other by a resin material (not illustrated). Such a resin material may be polyimide resin, polyamide resin, epoxy resin, polycarbonate resin, acryl resin, fluorine resin, or the like, for example. The substrate in this embodiment has a configuration in which the supply flow channel that supplies the ink includes three supply flow channels that are sequentially communicating with each other, which are the first supply flow channel 6, the second supply flow channel 7, and the third supply flow channel 8. That is, the first supply flow channel 6 communicates with the second supply flow channel 7, and the second supply flow channel 7 communicates with the third supply flow channel 8.

The flow channel formation member 4 has a configuration in which a top panel 14 facing the first substrate 2 and a side wall 15 positioned between the top panel 14 and the first substrate 2 are integrally formed. The top panel 14 includes an ejection port 16 from which the ink is ejected. The flow channel formation member 4 forms a flow channel 17 and a pressure chamber 18 between the flow channel formation member 4 and the first substrate 2. The pressure chamber 18 is a space region formed in a position facing the ejection port 16, and the flow channel 17 communicates with this pressure chamber 18. Additionally, the flow channel 17 communicates with the first supply flow channel 6 formed in the first substrate 2. With this configuration, the ink supplied from outside the liquid ejection head H passes through the third supply flow channel 8 and the second supply flow channel 7 in the second substrate 3 and is supplied to the first supply flow channel 6 in the first substrate 2, and then the ink is further supplied from the first supply flow channel 6 to the pressure chamber 18 through the flow channel 17. The ink supplied to the pressure chamber 18 is ejected from the ejection port 16 by the ejection energy (thermal energy) generated by the ejection element 5.

The flow channel formation member 4 is formed of positive type photosensitive resin or negative type photosensitive resin. If light resistance and patternability are taken into consideration, it is favorable to form the flow channel formation member 4 with negative type photosensitive resin. If a degree of freedom in manufacturing steps and reliability of the product are taken into consideration, it is favorable to use resin that has high resistance to heat and chemicals. Such resin may be polyimide resin, polyamide resin, epoxy resin, polycarbonate resin, acryl resin, fluorine resin, or the like, for example. One type of photosensitive resin may be used independently, or two or more types of photosensitive resin may be used together as the resin. The photosensitive resin may contain any of a photo-acid-generating agent, a sensitizer, a reductant, an adhesion improvement additive, a water repellent, an electromagnetic wave absorption member, and the like or all of the above. Thermoplastic resin, resin for softening point control, resin for improving strength, and the like may be added to the photosensitive resin. The flow channel formation member 4 may be formed by combining separate resin materials to form the top panel 14 and the side wall 15.

(Groove Portion)

In the liquid ejection head H, a groove portion 10 forming a bottomed shape is formed in a position close to the third supply flow channel opening 9 formed in the second surface 3*b* of the second substrate 3. In this case, the position close to the third supply flow channel opening 9 indicates a position that is determined based on the third supply flow channel opening 9 determined based on the tolerance (upper limit of error) and that communicates with the third supply flow channel opening 9 once the third supply flow channel opening 9 exceeds the tolerance (upper limit of error). It is preferable to form multiple groove portions 10 above, below, right, and left (in the X direction and the Y direction) of the third supply flow channel opening 9 as illustrated in FIG. 2. The third supply flow channel opening 9 may be expanded not only in the X direction but also in the Y direction during the etching processing. Therefore, it is more preferable to not only form the groove portions 10 close to the two sides on right and left of the third supply flow channel opening 9 forming the parallelogram but also form the groove portions 10 close to the upper and lower sides thereof. That is, the formation of the groove portions 10 close to the sides of the third supply flow channel opening 9 makes it possible to determine the quality of the shape of the third supply flow channel opening 9 in the X direction and the Y direction. In a case where the third supply flow channel opening 9 is properly etched, the groove portions 10 do not communicate with the third supply flow channel opening 9 and maintain the independent opening shape as illustrated in FIG. 2.

The opening shape of the groove portions 10 may be any of parallelogram, square, rectangle, polygon, and circle. In a case where a silicon substrate having a crystal orientation of <110> is used, and the groove portions 10 are formed by anisotropic wet etching, it is preferable to form the openings of the groove portions 10 in parallelogram, which allows for easy control of the etching shape in the plane (111). In the case where the etching shape is controlled, it is favorable that interior angles of the parallelogram have an acute angle of about 70.6° (an obtuse angle of about 109.4°).

FIG. 3 is a schematic plan view illustrating a process of etching the second substrate in the liquid ejection head H in this embodiment. Here, a case where the third supply flow channel opening 9 and the groove portions 10 are formed in parallelogram in the second surface 3*b* of the second substrate 3 while using a silicon substrate having a crystal orientation of <110> as the second substrate 3 is adopted as an example for the descriptions. In a case where the second supply flow channel 7, the third supply flow channel 8, and the groove portions 10 are formed by crystal anisotropic etching, mask patterns are provided for the first surface 3*a* and the second surface 3*b* of the second substrate 3, respectively; however, for the sake of convenience, illustration of the mask patterns is omitted herein.

Figure 3A:
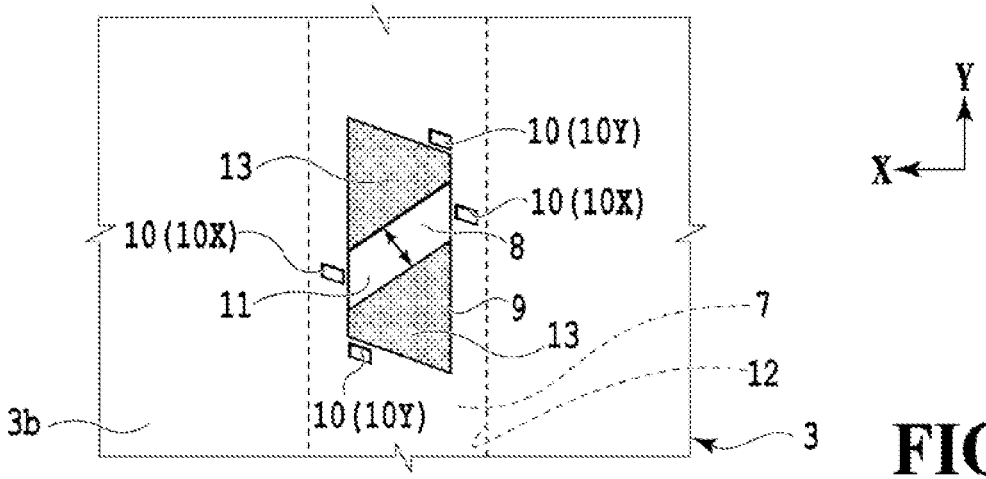
FIGS. 3A, 3B, and 3C are schematic plan views illustrating a process of etching a substrate for the liquid ejection head illustrated in FIG. 1.

FIG. 3A illustrates a state immediately after the second supply flow channel 7 and the third supply flow channel 8 communicate with each other in the communication portion 11 (see FIG. 1) by etching processing on the second substrate 3. In this state, inside of the third supply flow channel 8 is formed of the plane (111). The inclined portion 13 inside the third supply flow channel 8 is inclined from the second surface 3*b* of the second substrate 3 toward the first surface 3*a* of the second substrate 3 at an angle of about 35.3°, where an acute angle portion of interior angles of the third supply flow channel opening 9 forming the parallelogram is a vertex (see FIG. 1).

Figure 3B:
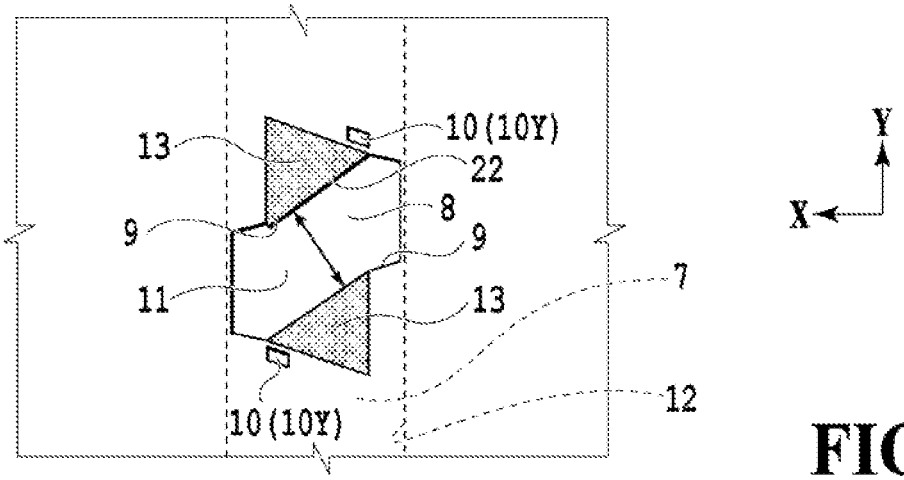

As illustrated in FIG. 3B, once the shape of the communication portion 11 of the second supply flow channel 7 and the third supply flow channel 8 cannot maintain the plane (111) with the progress in the crystal anisotropic etching, a plane (112) of about 54.7° appears at a tip end 22 of the inclined portion 13 in contact with the communication portion 11. If the plane (112) that is more likely to be etched than the plane (111) appears, a phenomenon that the expansion speed of the communication portion 11 is increased occurs. Additionally, since the shape of the third supply flow channel opening 9 is likely to follow the shape of the second supply flow channel opening 12 starting from the communication portion 11, the third supply flow channel opening 9 also disintegrates gradually in the X direction. Once the shape of the third supply flow channel opening 9 exceeds the tolerance in the X direction due to this disintegration, the third supply flow channel opening 9 communicates with groove portions 10X, which are formed close to the third supply flow channel opening 9 in the X direction. Consequently, the disintegration of the third supply flow channel opening 9 is accelerated, and the groove portions 10X are incorporated into the third supply flow channel 8.

Figure 3C:
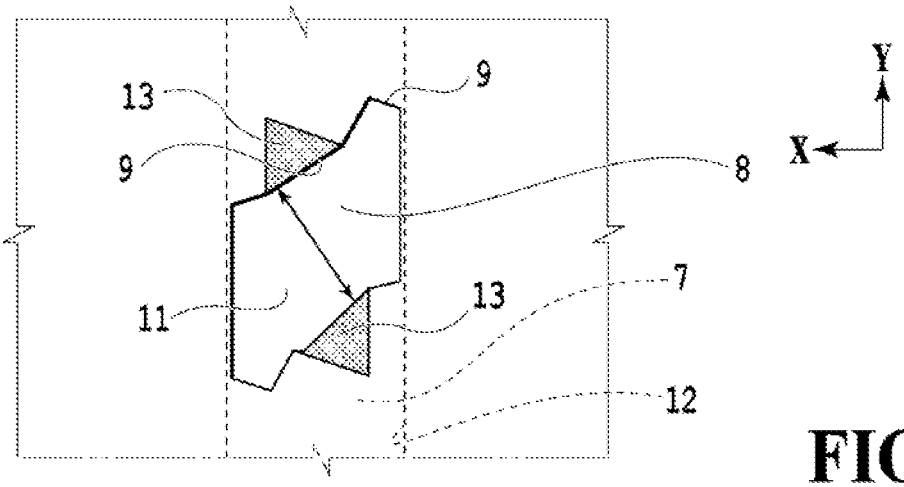

In this embodiment, as illustrated in FIG. 3C, groove portions 10Y are formed close to the third supply flow channel opening 9 in the Y direction. Therefore, once the third supply flow channel opening 9 reaches the groove portions 10Y arranged in the Y direction with the progress in the etching, the disintegration of the third supply flow channel opening 9 is accelerated in the Y direction as well. Accordingly, the groove portions 10Y arranged in the Y direction are also incorporated into the third supply flow channel 8. Thus, in this embodiment, in the case where the third supply flow channel 8 is etched to exceed the tolerance, the disintegration of the third supply flow channel opening 9 is accelerated by communicating with the groove portions 10 (10X and 10Y), and thus the third supply flow channel opening 9 is expanded largely. Consequently, it is possible to easily determine the quality of the second substrate 3.

(Arrangement of Groove Portions)

As illustrated in FIG. 3A, all the four groove portions 10 (10X and 10Y) arranged around (outside) the third supply flow channel opening 9 need to be arranged within the inside of the second supply flow channel opening 12 in plan view from above the second surface 3*b* of the second substrate 3. This is because of the following reasons. In the case of using a silicon substrate having a crystal orientation of <110> as the second substrate 3, the third supply flow channel opening 9 positioned inside the second supply flow channel opening 12 does not disintegrate equal to or more than the width of the second supply flow channel opening 12. Therefore, if the groove portions 10 are arranged outside the second supply flow channel opening 12, the third supply flow channel opening 9 never reaches the groove portions 10 even in the case where the third supply flow channel opening 9 is formed to exceed the tolerance by etching, and the groove portions 10 are maintained constantly independent of the third supply flow channel opening 9. As described above, the groove portions 10 have a function of enabling easy determination on the abnormality of the opening shape by communicating with the third supply flow channel opening 9 and expanding the third supply flow channel opening 9 largely once the third supply flow channel opening 9 is etched to the size exceeding the tolerance. Therefore, if the groove portions 10 are arranged outside the second supply flow channel opening 12, the groove portions 10 do not communicate with the third supply flow channel opening 9, and thus the groove portions 10 cannot perform the function thereof. For this reason, the groove portions 10 need to be arranged within inside the second supply flow channel opening 12.

In the case where the shape of the third supply flow channel opening 9 is parallelogram as illustrated in FIG. 3A, it is favorable to arrange the groove portions 10 outside interior angle portions, which are obtuse angles of the parallelogram. This is because, as illustrated in FIG. 3B, the shape of the communication portion 11 of the second supply flow channel 7 and the third supply flow channel 8 disintegrates from a portion of the communication portion 11 that is close to an interior angle portion as an obtuse angle of the third supply flow channel opening 9 forming the parallelogram. The groove portions 10 arranged outside the third supply flow channel opening 9 in the X direction and the groove portions 10 arranged in the Y direction are all arranged based on the tolerance of the third supply flow channel opening 9 in the X direction and the Y direction. That is, the groove portions 10 are arranged in positions in which the groove portions 10 communicate with the third supply flow channel opening 9 once the third supply flow channel opening 9 exceeds the tolerance. For example, in a case where the width of the third supply flow channel opening 9 in the X direction exceeds the tolerance, the third supply flow channel opening 9 communicates with the groove portions 10 provided outside the third supply flow channel opening 9 in the X direction. As a result, the third supply flow channel opening 9 is expanded as illustrated in FIG. 3B. On the other hand, in the case where the width in the Y direction of the third supply flow channel opening 9 exceeds the tolerance, the third supply flow channel opening 9 communicates with the groove portions 10 provided outside the third supply flow channel opening 9 in the Y direction. As a result, the third supply flow channel opening 9 is expanded as illustrated in FIG. 3C. In the state illustrated in FIG. 3C, a portion of the third supply flow channel opening 9 expanded due to the communication with the groove portions 10X and a portion thereof expanded due to the communication with the groove portions 10Y communicate with each other, and thus the third supply flow channel opening 9 becomes a large opening expanded in both the X and Y directions. Occurrence of excessive etching that makes the third supply flow channel opening 9 exceed the tolerance allows for easy determination on the quality of the substrate by observing the third supply flow channel opening 9 and the second surface 3*b* of the second substrate 3. In this embodiment, the determination on the quality of the substrate can be performed easily by visual checking or by using a low-powered microscope.

(Depth of Groove Portions)

It is favorable to form the depth of the groove portions 10 formed in the second surface 3*b* of the second substrate 3 shallower than the depth of the third supply flow channel 8 formed in the second surface 3*b* (distance from the third supply flow channel opening 9 to the communication portion 11). This is for avoiding the communication of the groove portions 10 with the second supply flow channel 7 before the third supply flow channel opening 9 is formed. This is because, if the groove portions 10 communicate with the second supply flow channel 7 before the third supply flow channel opening 9 does, there is a risk that the shape of the groove portions 10 including the plane (111) cannot be maintained, and the groove portions 10 may communicate with the third supply flow channel opening 9 due to the shape disintegration of the groove portions 10. It is favorable that the shape of the groove portions 10 is maintained until the third supply flow channel opening 9 exceeds the tolerance and communicates with the groove portions 10.

(Width of Groove Portions)

In the case where the groove portions 10 are formed in a silicon substrate having a crystal orientation of <110> by wet etching, it is favorable to form the opening width of the groove portions 10 in the X direction and the opening width thereof in the Y direction narrower than the opening width of the third supply flow channel opening 9 in the X direction and the opening width thereof in the Y direction. This is for avoiding the communication of the groove portions 10 with the second supply flow channel 7 before the third supply flow channel opening 9 is formed, as described above. This is because, if the opening width of the third supply flow channel opening 9 is greater than the opening width of the groove portions 10, the shape of the groove portions 10 including the plane (111) cannot be maintained.

(Modification of First Embodiment)

Figure 4:
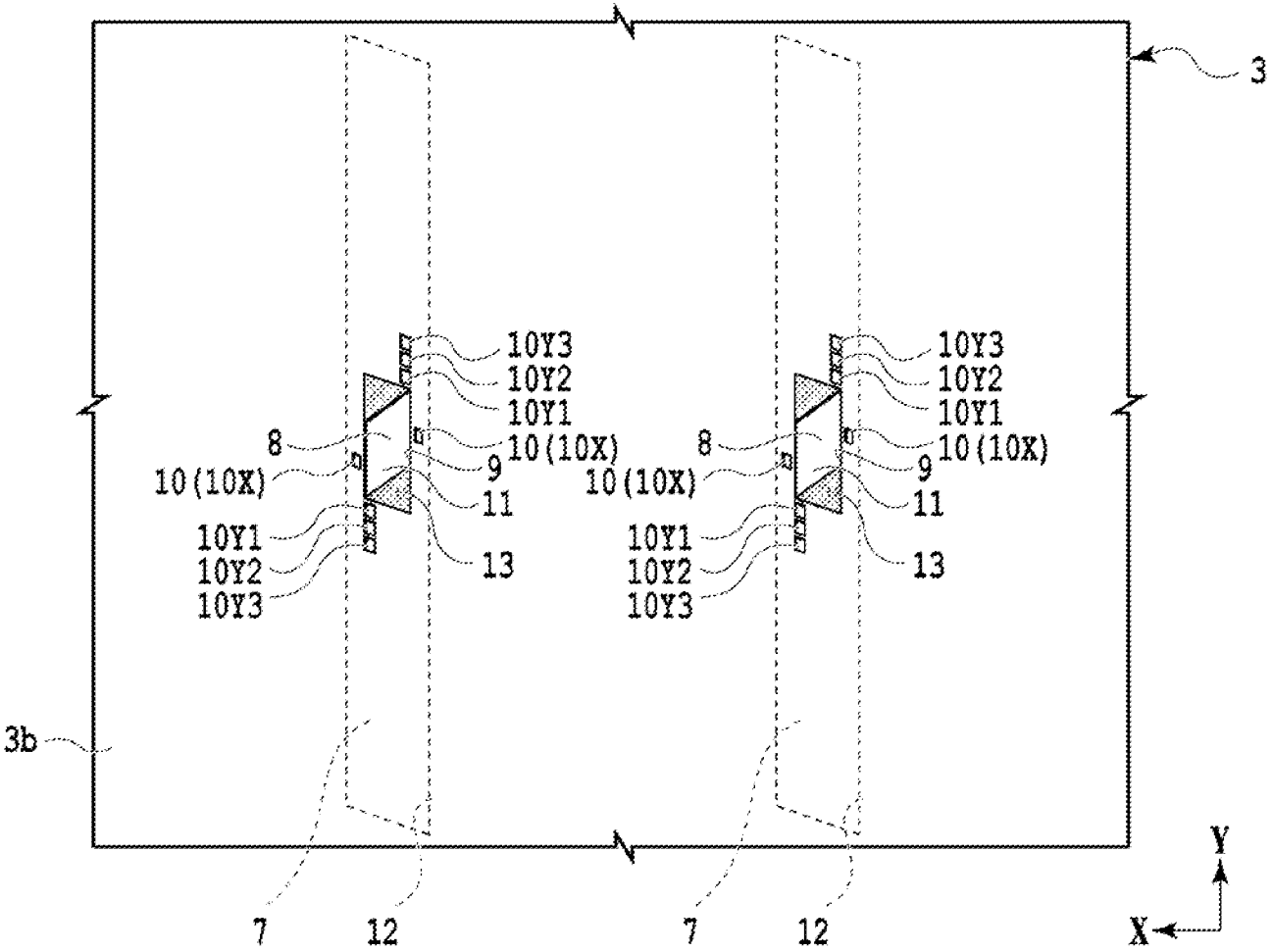
FIG. 4 is a schematic plan view illustrating a part of a substrate for the liquid ejection head in a modification.

FIG. 4 illustrates a modification of the arrangement of the groove portions 10 in the above-described embodiment. FIG. 4 is a schematic plan view of the second substrate 3 in this modification. In this modification, the multiple groove portions 10Y are formed along the Y direction in the second surface 3*b* of the second substrate 3. Out of the groove portions 10Y, groove portions 10Y1 arranged in positions closest to the third supply flow channel opening 9 are formed similarly as the groove portions OY described in the above-described first embodiment. That is, the groove portions 10Y are formed in the positions in which the groove portions 10Y1 communicate with the third supply flow channel opening 9 once the third supply flow channel opening 9 exceeds the tolerance in the Y direction. Additionally, in this modification, multiple (two in FIG. 4) groove portions 10Y2 and 10Y3 are formed sequentially at regular intervals from each of the groove portions 10Y1 along the Y direction.

With the multiple groove portions 10Y1, 10Y20, and 10Y3 formed in the Y direction as described above, it is possible to expand the third supply flow channel opening 9 in a wider range in the case where the third supply flow channel opening 9 is formed to exceed the designed tolerance in the Y direction. That is, once the third supply flow channel opening 9 and the groove portions 10Y1 communicate with each other and the third supply flow channel opening 9 is expanded, the third supply flow channel opening 9 is further expanded successively to the groove portions 10Y2 and 10Y3, and eventually the third supply flow channel opening 9 is expanded to a further greater range than that in the first embodiment. Consequently, in the case where the third supply flow channel opening 9 is formed to exceed the designed tolerance, it is possible to confirm the defection of the second substrate 3 more reliably and easily.

In this modification, the independent groove portions 10Y1 to 10Y3 having narrow opening width are formed independently without forming a groove portion continuous in the Y direction in the third supply flow channel opening 9. This is because of the following reasons. If the substrate is a silicon substrate having a crystal orientation of <110>, it is possible to stop the progress in the etching at a shallower position as the width of the opening portion is narrower. Therefore, it is possible to make the depth of the groove portions 10Y1 to 10Y3 shallow by forming the multiple groove portions 10Y1 to 10Y3 having narrow opening width like this modification. As described above, it is favorable to form the depth of the groove portions 10Y1 to 10Y3 shallower than that of the third supply flow channel 8. Thus, it is possible to inhibit the groove portions 10 from communicating with the second supply flow channel 7 before the third supply flow channel 8 does by forming the multiple groove portions having narrow opening width like this modification. Therefore, this modification is particularly effective if the third supply flow channel 8 is desired to be formed shallow.

(Manufacturing Method)

Next, an example of a method of manufacturing the liquid ejection head H described in the first embodiment and the modification with reference to FIGS. 5A to 7. FIGS. 5A to 5D and 6A to 6C are schematic cross-sectional views that illustrate in stages the method of manufacturing the substrate for the liquid ejection head and are cross-sectional views from the same direction as FIG. 1. In FIGS. 5A to 5D and 6A to 6C, the X direction indicates a direction in which the second supply flow channel 7 extends, and the Y direction indicates a direction orthogonal to the X direction like other drawings.

Figure 5A:
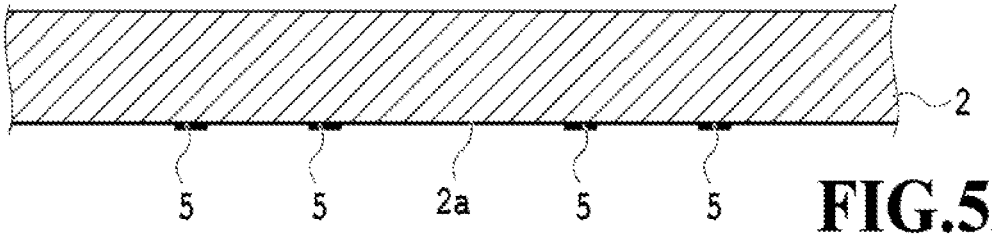
FIGS. 5A to 5D are schematic cross-sectional views illustrating a method of manufacturing the substrate for the liquid ejection head in the first embodiment.

First, as illustrated in FIG. 5A, the ejection element 5 using a TaSiN film, a protection film formed of SiN (not illustrated), and electric structures (not illustrated) such as the driving circuit of the ejection element 5, wiring, and the connection terminal are formed on the first surface 2*a* of the first substrate 2. In this example, a silicon substrate having a crystal orientation of <100> having a thickness of about 300 pam is used as the first substrate 2.

Figure 5B:
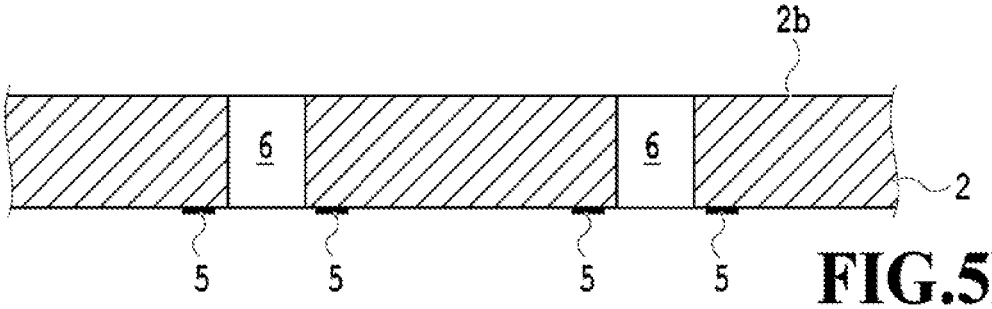

Next, as illustrated in FIG. 5B, the first supply flow channel 6 penetrating the first substrate 2 from the first surface 2*a* to the second surface 2*b* is formed in the first substrate 2. The first supply flow channel 6 can be formed by any one of methods such as laser processing, reactive ion etching, sandblasting, and wet etching, or by a combination of multiple methods. The first supply flow channel 6 may be formed in stages through multiple manufacturing steps. In this example, the first supply flow channel 6 is formed by reactive ion etching. The opening width of the first supply flow channel 6 in the X direction in this example is about 500 μm.

Figure 5C:
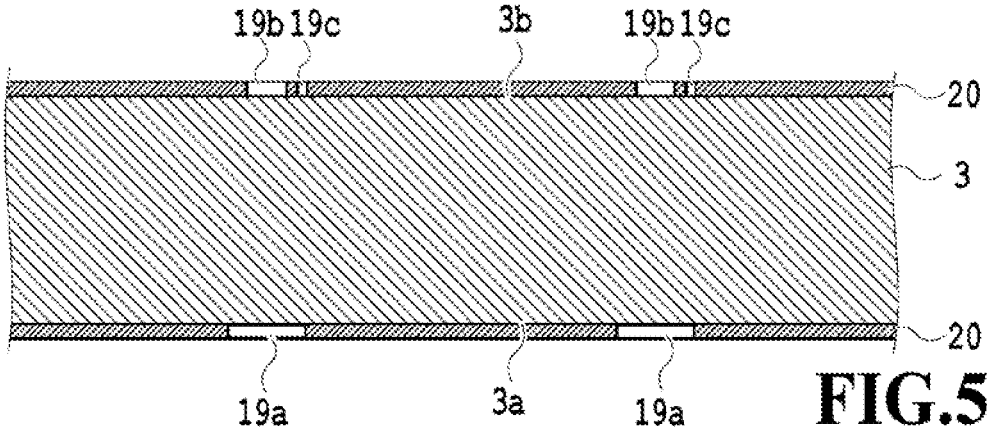

Meanwhile, as illustrated in FIG. 5C, the second substrate 3 in which thermal oxide films 20 resistant to etching are provided on the two surfaces, respectively, is prepared. A silicon substrate having a crystal orientation of <110> having a thickness of about 600 μm is used as the second substrate. On the film 20 provided on the first surface 3*a* of the second substrate 3, a mask pattern 19*a* for forming the second supply flow channel 7 illustrated in FIG. 1 is formed. On the second surface 3*b* of the second substrate 3, a mask pattern 19*b* for forming the third supply flow channel 8 and a mask pattern 19*c* for forming the groove portions 10 illustrated in FIG. 1 are formed. The film 20 resistant to etching may be a thermal oxide film, a photoresist, or the like. In this example, thermal oxide films 20 are provided on the two surfaces of the second substrate 3, respectively.

In the mask pattern 19*a* for forming the second supply flow channel in this example, the opening width in the X direction is about 500 μm, and the opening width in the Y direction is about 20000 μm. In the mask pattern 19*b* for forming the third supply flow channel, the opening width in the X direction is about 300 μm, and the opening width in the Y direction is about 600 μm. In the mask pattern 19*c* for forming the groove portions, the opening width in the X direction is about 80 pam, and the opening width in the Y direction is about 50 μm.

Figure 5D:
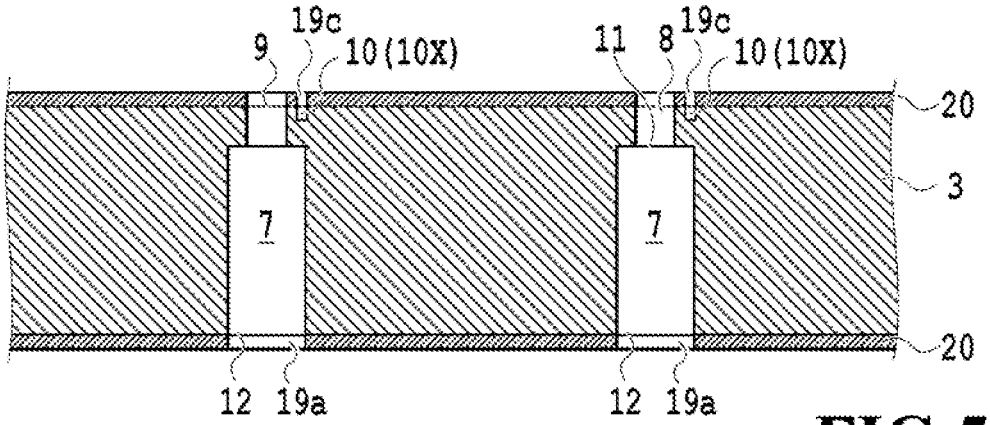

Next, as illustrated in FIG. 5D, in the second substrate 3 provided with the films 20, the second supply flow channel 7 and the third supply flow channel 8 are formed by using the mask patterns 19*a*, 19*b*, and 19*c*. Accordingly, the second supply flow channel opening 12 is formed in the first surface 3*a* of the second substrate 3, and the third supply flow channel opening 9 and the openings of the groove portions 10 are formed in the second surface 3*b* of the second substrate 3. The second supply flow channel 7, the third supply flow channel 8, and the groove portions 10 may be formed concurrently or may be formed individually from the two surfaces of the second substrate 3. As with the first supply flow channel 6, it is possible to form the second supply flow channel 7, the third supply flow channel 8, and the groove portions 10 by any one of methods such as laser processing, reactive ion etching, sandblasting, and wet etching, or by a combination of multiple methods. The second supply flow channel 7, the third supply flow channel 8, and the groove portions 10 may be formed in stages through multiple manufacturing steps. However, it is favorable to form the groove portions 10 before the second supply flow channel 7 and the third supply flow channel 8 communicate with each other in the communication portion 11. This is because, if only the groove portions 10 are formed separately after the second supply flow channel 7 and the third supply flow channel 8 are formed, the shape of the third supply flow channel opening 9 does not disintegrate largely even if the third supply flow channel opening 9 is formed to a range exceeding the tolerance and communicates with the groove portions 10. If the shape of the third supply flow channel opening 9 does not disintegrate largely, it may be difficult to determine whether the manufactured liquid ejection head H is a defective item.

In this example, wet etching (crystal anisotropic wet etching) using a water solution of tetramethylammonium hydroxide is performed, and the second supply flow channel 7, the third supply flow channel 8, and the groove portions 10 are formed concurrently. Even in a case where wet etching is performed concurrently from the two surfaces of the second substrate 3 to form the second supply flow channel 7, the third supply flow channel 8, and the groove portions 10, the depths of the second supply flow channel 7, the third supply flow channel 8, and the groove portions 10 can have selectivity. This can be made by individually setting the opening width of the mask pattern 19*a* for forming the second supply flow channel, the opening width of the mask pattern 19*b* for forming the third supply flow channel, and the opening width of the mask pattern 19*c* for forming the groove portions. For example, the opening widths of the mask patterns 19*b* and 19*c* are defined such that the third supply flow channel 8 and the groove portions 10 are blocked by the plane (111) of silicon having a slow etching rate during the etching. This makes it possible to continue etching of the second supply flow channel 7 while maintaining the state where etching of the third supply flow channel 8 and the groove portions 10 in their depth directions is intendedly stopped during the etching process. That is, it is possible to allow the etching depth to have selectivity.

In this example, as a result of performing the etching processing, the depth of the second supply flow channel 7 formed in the second substrate 3 is about 450 μm. The depth of the third supply flow channel 8 is about 150 μm, and the depth of the groove portions 10 is about 40 μm. The opening width of the second supply flow channel 7 in the X direction is about 500 μm, and the opening width thereof in the Y direction is about 20000 μm. The opening width of the third supply flow channel 8 in the X direction is about 300 μm, and the opening width thereof in the Y direction is about 600 μm. The opening width of the groove portions 10 in the X direction is about 80 μm, and the opening width thereof in the Y direction is about 50 μm.

Next, whether the third supply flow channel opening 9 is properly formed in the second substrate 3 is examined. This examination is carried out according to the procedure in the flowchart of FIG. 7. First, in S1, exteriors of the third supply flow channel opening 9 and the groove portions 10 are observed by visual checking or by using a low-powered microscope. As a result of the observation, if it is confirmed that the third supply flow channel opening 9 does not reach the groove portions 10, and all the groove portions 10 (10X and 10Y) remain (S2), this means that the shape of the third supply flow channel opening 9 is within the tolerance, and thus it is determined that the second substrate 3 is a non-defective item (S3).

Figure 8:
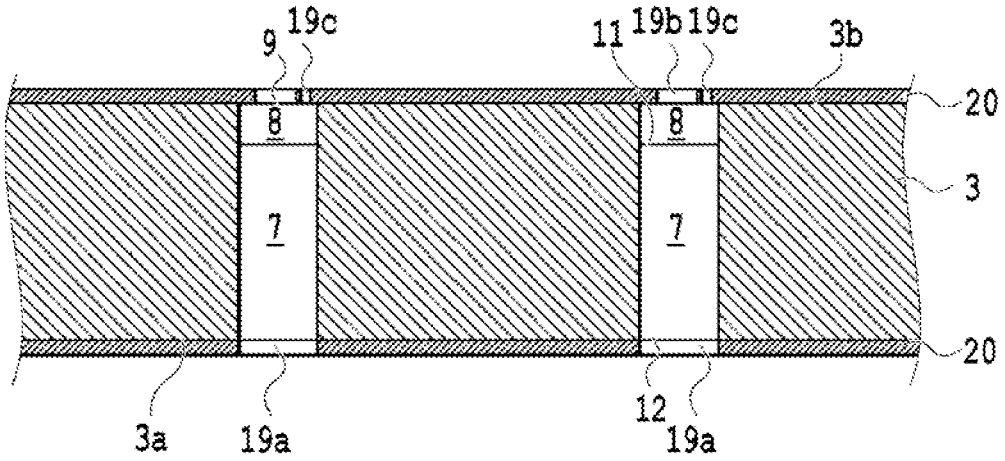
FIG. 8 is a schematic cross-sectional view illustrating a state where the substrate for the liquid ejection head is defective.

On the other hand, as a result of the observation in S1, if the third supply flow channel opening 9 disintegrates largely, and at least one of the groove portions 10 is incorporated into the third supply flow channel opening 9 (S4), it is determined that the second substrate 3 is a defective item (S5). That is, it is determined that the second substrate 3 in which the third supply flow channel opening 9 and the groove portions 10 communicate with each other as illustrated in FIGS. 3B to 3C and 8 is a defective item. Although the films 20 including the mask patterns 19*a*, 19*b*, and 19*c* remain on the two surfaces of the second substrate 3 in this examination step, it is possible to confirm the shape of the third supply flow channel opening 9 while keeping the films 20.

Figure 6A:
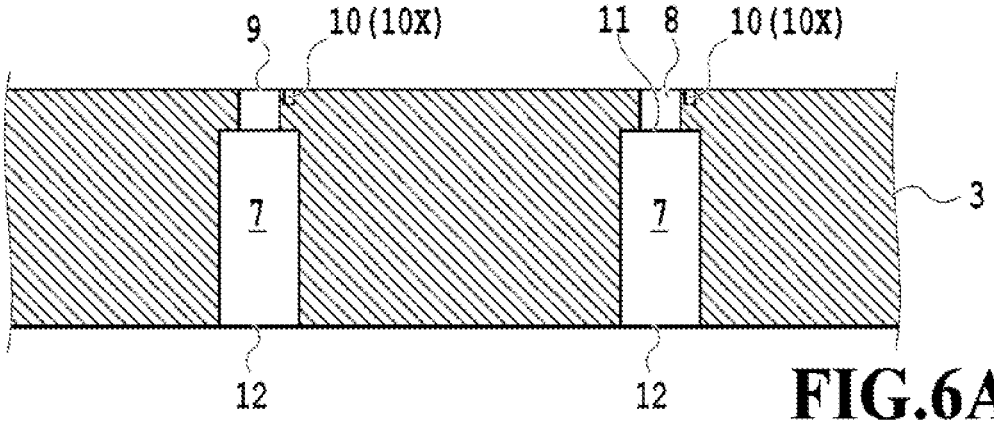
FIGS. 6A to 6C are schematic cross-sectional views illustrating the method of manufacturing the substrate for the liquid ejection head in the first embodiment.

After the above-described examination step, the films 20 including thermal oxide films formed on the two surfaces of the second substrate 3 are removed from the second substrate 3 that is determined as a non-defective item by using hydrofluoric acid. This state is illustrated in FIG. 6A.

Figure 6B:
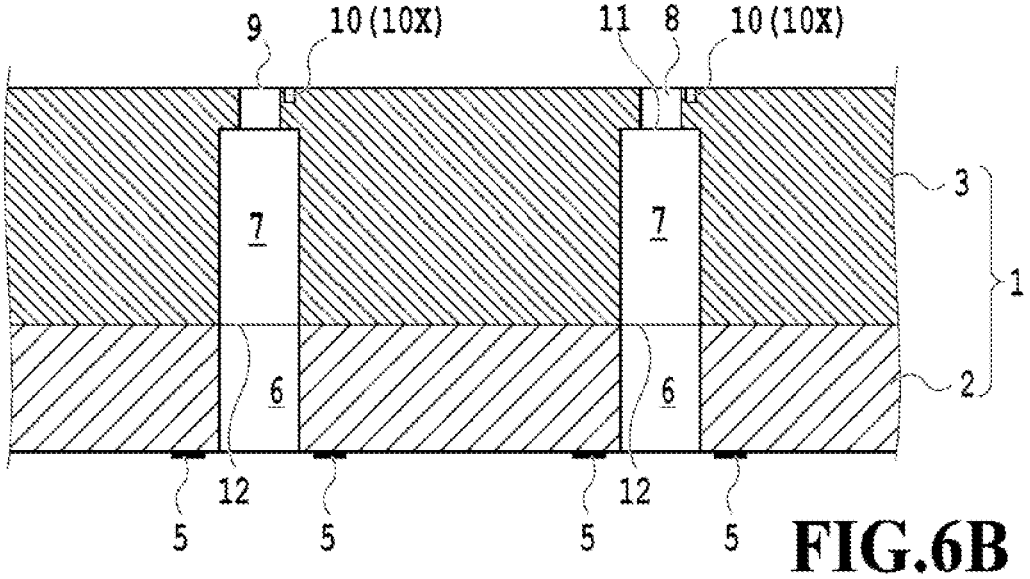

Next, as illustrated in FIG. 6B, the second surface 2*b* of the first substrate 2 and the first surface 3*a* of the second substrate 3 are adhered to each other by an adhesive (not illustrated). A method of adhesion may be adhesion by a resin material or the like, fusion bonding in which bonding progresses spontaneously by putting activated surfaces in contact with each other, eutectic bonding, diffusion bonding, or the like. In this example, the second surface 2*b* of the first substrate 2 and the first surface 3*a* of the second substrate 3 are adhered to each other by thermosetting epoxy resin (not illustrated) and then cured by thermal processing.

Figure 6C:
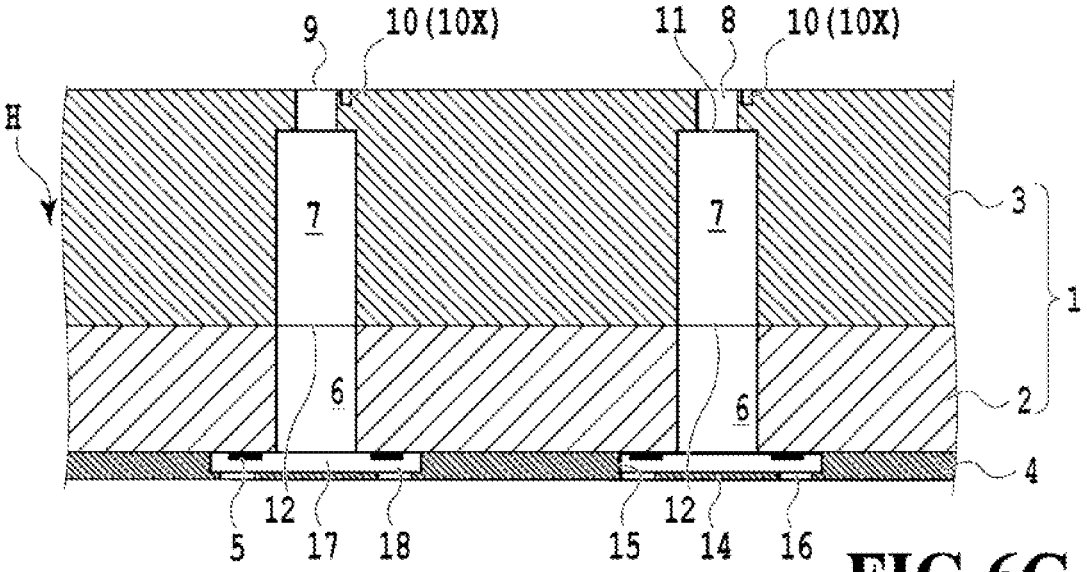
Figure 7:
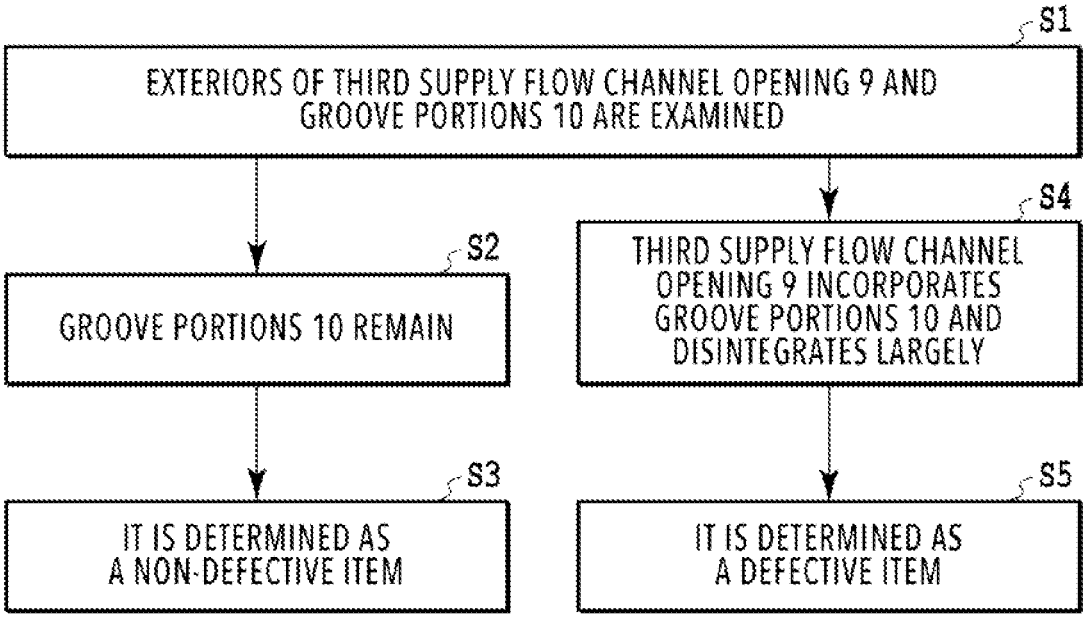
FIG. 7 is a flowchart illustrating steps of examining the substrate for the liquid ejection head.

As illustrated in FIG. 6C, the flow channel formation member 4 is formed on the first surface 2*a* of the first substrate 2. In the flow channel formation member 4, the side wall 15 and the top panel 14 are formed, and the ejection port 16 is formed in the top panel by photolithography. The flow channel 17 and the pressure chamber 18 are formed between the top panel 14 and the first substrate 2. The flow channel formation member 4 may be formed by laminating the top panel 14 and the side wall 15 using different pieces of photosensitive resin. In this example, the flow channel formation member 4 is formed by using two types of dry films formed of epoxy resin to which a photo-acid-generating agent is added. Specifically, the flow channel formation member 4 is formed by the following steps. First, a first layer, which is a dry film as the side wall 15, is laminated on the first surface 2*a* of the first substrate 2, the first layer is exposed thereafter, and a second layer, which is a dry film as the top panel 14, is laminated on the first layer as the side wall 15. Then, the second layer is exposed, and the first layer and the second layer are developed together. Thereafter, the pattern of the flow channel formation member 4 is cured by thermal processing. Finally, electric connection is made, and the liquid ejection head H is completed. FIGS. 5D and 6A to 6C do not illustrate the inclined portion 13 formed in the third supply flow channel 8 and the inclined portions formed in the groove portions 10 for the sake of convenience.

In the liquid ejection head H manufactured through the above-described steps, all the groove portions 10 are formed around the third supply flow channel opening 9, and this makes it possible to easily confirm that the liquid ejection head H is a non-defective item. In contrast, if the third supply flow channel opening 9 disintegrates to the groove portions 10 during the etching processing, the disintegration of the third supply flow channel opening 9 starting from the groove portions 10 is accelerated, and the shape of the third supply flow channel opening 9 is deformed largely. Therefore, it is possible to easily and reliably determine the defection of the second substrate in the examination step. Accordingly, the possibility of manufacturing the liquid ejection head H including a defective second substrate 3 is reduced.

Comparative Example

Figure 11A:
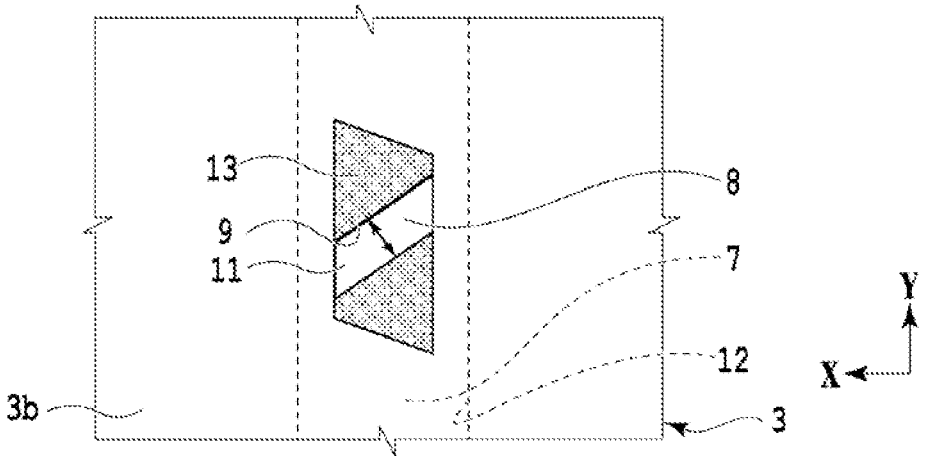
FIGS. 11A to 11C are schematic plan views illustrating a process of etching a liquid ejection head in a comparative example.
Figure 11B:
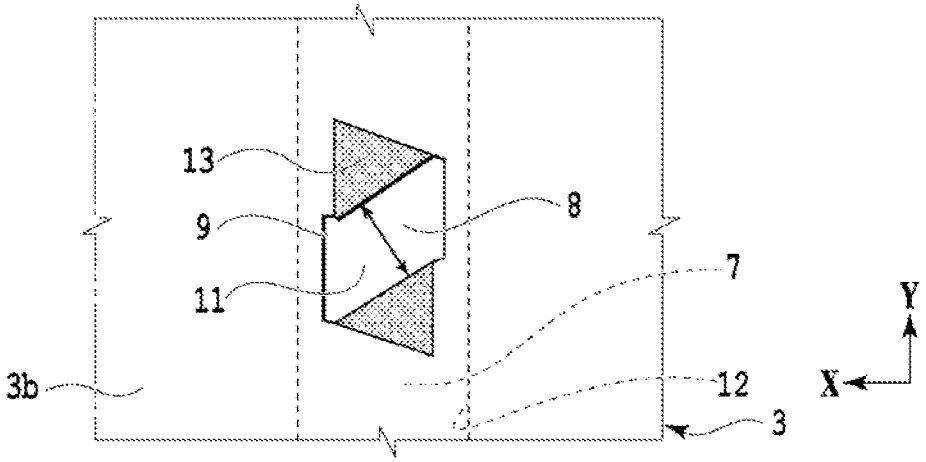
Figure 11C:
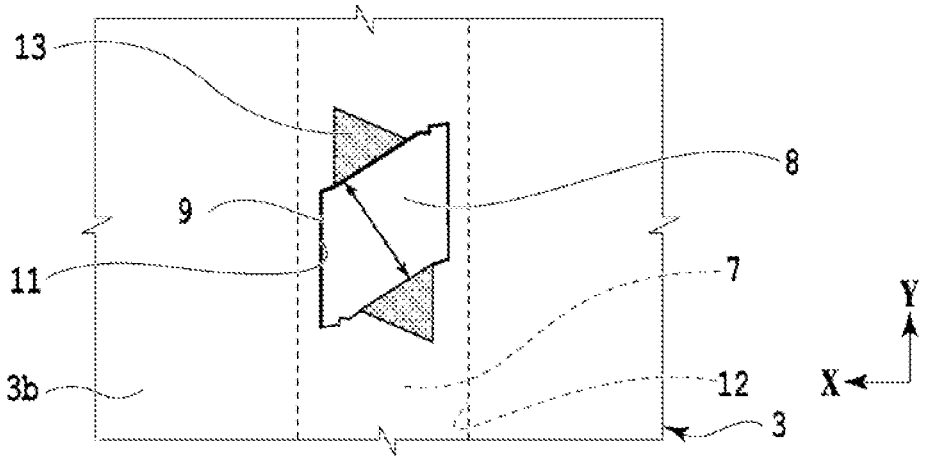

FIGS. 11A to 11C are plan views schematically illustrating a process of etching the liquid ejection head in a comparative example. In this comparative example, the groove portions 10 (for example, see FIG. 3) as described in the above embodiments are not formed on the second surface 3*b* of the second substrate 3, and this is a different point from the above-described embodiments. Other configurations are the same as that of the above-described embodiments, and duplicated descriptions for the same configurations are omitted. FIGS. 11A to 11C do not illustrate the mask patterns for forming the second supply flow channel 7 and the third supply flow channel 8 for the sake of convenience.

FIG. 11A illustrates a state where the second supply flow channel 7 and the third supply flow channel 8 communicate with each other by the progress in the etching. Thereafter, once the shape of the communication portion 11 of the second supply flow channel 7 and the third supply flow channel S cannot maintain the plane (111) anymore, the third supply flow channel opening 9 gradually disintegrates to correspond to the shape of the communication portion 11. In the case where the third supply flow channel opening 9 is formed to exceed the tolerance (upper limit of error), the second substrate becomes a defective item. However, in the comparative example, since no grooves are formed around the third supply flow channel like the above-described embodiments, the opening width of the third supply flow channel opening 9 is not expanded largely as illustrated in FIGS. 11B and 11C even in the case where the third supply flow channel opening 9 exceeds the tolerance. FIG. 11B illustrates a state where the third supply flow channel opening 9 is etched to slightly exceed the tolerance, and FIG. 11C illustrates a state where the etching progresses from the state illustrated in FIG. 11B. In either of states in FIGS. 11B and 11C, the expansion of the third supply flow channel opening 9 is small; thus, it is difficult to determine the quality of the second substrate 3 by observing the third supply flow channel opening 9 by visual checking or by using a low-powered microscope. Therefore, the case of the comparative example requires to use an examination apparatus having an advanced examination function to perform precise shape examination and dimension measurement of the second substrate 3, and a lot of time and cost are required for the examination.

In contrast, in the above-described embodiments, once the third supply flow channel opening 9 exceeds the tolerance, the third supply flow channel opening 9 communicates with the groove portions 10, and the third supply flow channel opening 9 is expanded largely. Therefore, in the examination step, it is possible to easily and reliably determine the quality of the second substrate only by observing the third supply flow channel opening 9 by visually checking or by using a low-powered microscope. Consequently, there is no need to use an accurate examination apparatus to perform precise shape examination and dimension measurement of the second substrate 3, and it is possible to reduce the time and cost required for the examination.

Second Embodiment

Next, a method of manufacturing a liquid ejection head in a second embodiment of the present disclosure is described with reference to FIGS. 9A to 9D. In this embodiment, an example of manufacturing the second substrate 3 of the liquid ejection head H illustrated in FIG. 1 by a manufacturing method different from that described in the first embodiment is described. The descriptions of the method of manufacturing the first substrate 2 are omitted since the method is similar to that in the first embodiment.

FIGS. 9A to 9D is a drawing illustrating steps of forming the second supply flow channel 7, the third supply flow channel 8, and the groove portions 10 on the second substrate 3 in this embodiment. The manufacturing method in this embodiment is effective for a case where the opening width and the depth of the third supply flow channel 8 and the opening width and the depth of the groove portions 10 are controlled individually.

Figure 9A:
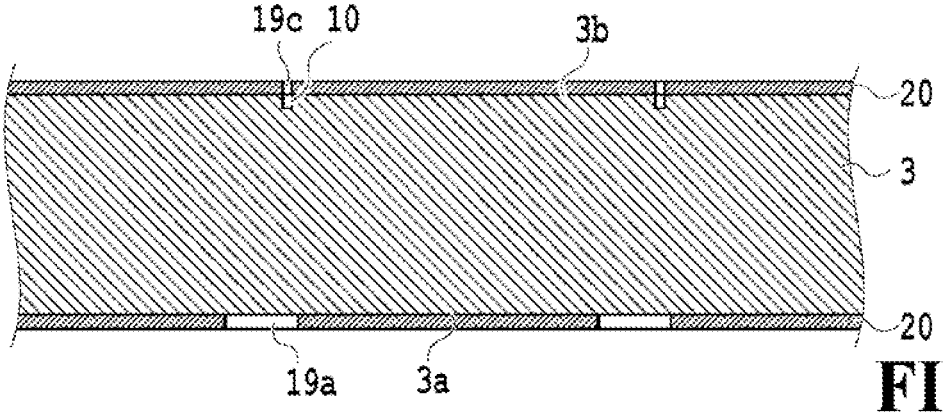
FIGS. 9A to 9D are schematic cross-sectional views illustrating a method of manufacturing a substrate for the liquid ejection head in a second embodiment.

First, as illustrated in FIG. 9A, the second substrate 3 in which the films 20 resistant to etching on the two surfaces, the mask pattern 19*a* for forming the second supply flow channel 7, and the mask pattern 19*c* for forming the groove portions 10 are formed is prepared. In this example, a silicon substrate having a thickness of about 600 μm in which the thermal oxide films 20 are formed is used as the second substrate 3. A crystal orientation of the silicon substrate is <110>. The mask pattern 19*a* for forming the second supply flow channel is formed on the thermal oxide film 20 formed on the first surface 3*a* of the second substrate 3, and the mask pattern 19*c* for forming the groove portions 10 is formed on the thermal oxide film 20 formed on the second surface 3*b* of the second substrate 3. The opening width of the mask pattern 19*a* in the X direction is about 500 μm, and the opening width thereof in the Y direction is about 20000 μm. The opening width of the mask pattern 19*c* in the X direction is about 80 μm, and the opening width thereof in the Y direction is about 50 μm.

Next, the groove portions 10 are formed on the second surface 3*b* of the second substrate 3 by using the mask pattern 19*c*. It is possible to form the groove portions 10 by a method such as laser processing, reactive ion etching, and sandblasting. In this example, the groove portions 10 are formed by the Bosch process using reactive ion etching. The Bosch process is a method of performing anisotropic etching on silicon by repeating formation of a protection film containing carbon as a main component (not illustrated) and etching by an $SF_6$ gas and the like. The $SF_6$ gas is used for etching the second substrate 3, and a $C_4F_8$ gas is used for forming the protection film (not illustrated) on a side surface of a hole as the groove portions 10. The depth of the groove portions 10 in this example is about 40 μm. The opening width of the groove portions 10 in the X direction is about 80 μm, and the opening width thereof in the Y direction is about 50 μm. After etching, the protection film (not illustrated) formed by the Bosch process is removed by hydrofluoroether.

Figure 9B:
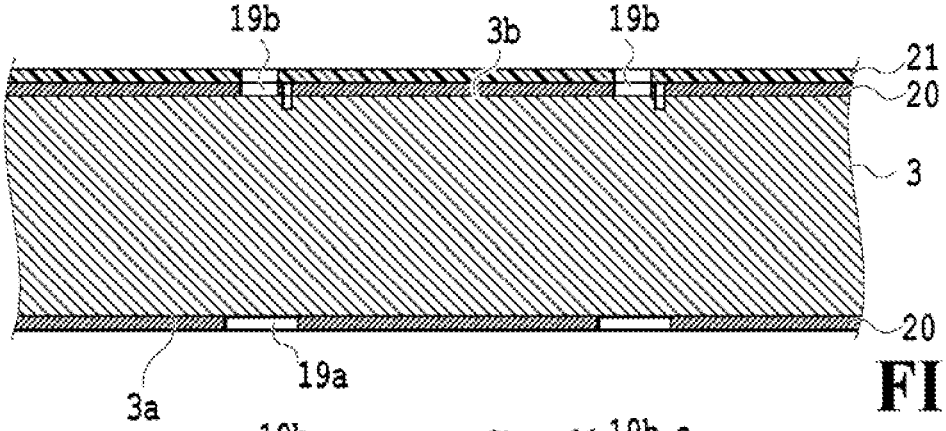

Next, as illustrated in FIG. 9B, a photoresist 21 as a mask is laminated on the second surface 3*b* of the second substrate 3. The material of the photoresist is not particularly limited as long as it is a photoresist resistant to etching. Thereafter, a mask pattern 21*a* is formed on the photoresist 21 by photolithography so as to form the mask pattern 19*b* for forming the third supply flow channel 8 in the second surface 3*b* of the second substrate 3 on the thermal oxide film 20. The groove portions 10 are maintained protected by the photoresist 21. This is to maintain the shape of the groove portions 10 formed by the Bosch process until immediately before the second supply flow channel 7 and the third supply flow channel 8 communicate with each other in the communication portion 11.

Next, the mask pattern 19*b* for forming the third supply flow channel 8 is formed on the second surface 3*b* of the second substrate 3 by partially removing the thermal oxide film 20 by hydrofluoric acid through the mask pattern 21*a* formed by photolithography. In this example, the opening width of the mask pattern 19*b* in the X direction is about 300 μm, and the opening width thereof in the Y direction is about 600 μm.

Figure 9C:
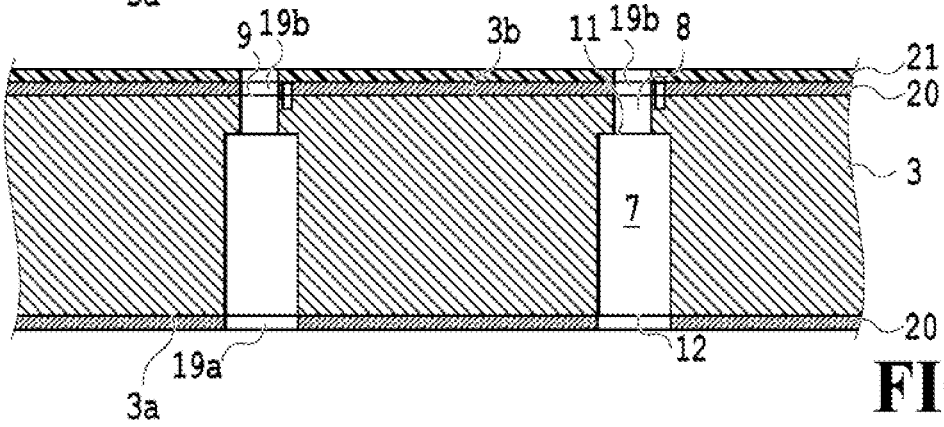

Next, as illustrated in FIG. 9C, the second supply flow channel 7 and the third supply flow channel 8 are formed in the second substrate 3 by etching. In this etching process, the groove portions 10 are incorporated into the third supply flow channel 8. In this example, the second supply flow channel 7 and the third supply flow channel 8 are concurrently formed by wet etching (crystal anisotropic etching) using a water solution of tetramethylammonium hydroxide.

Figure 9D:
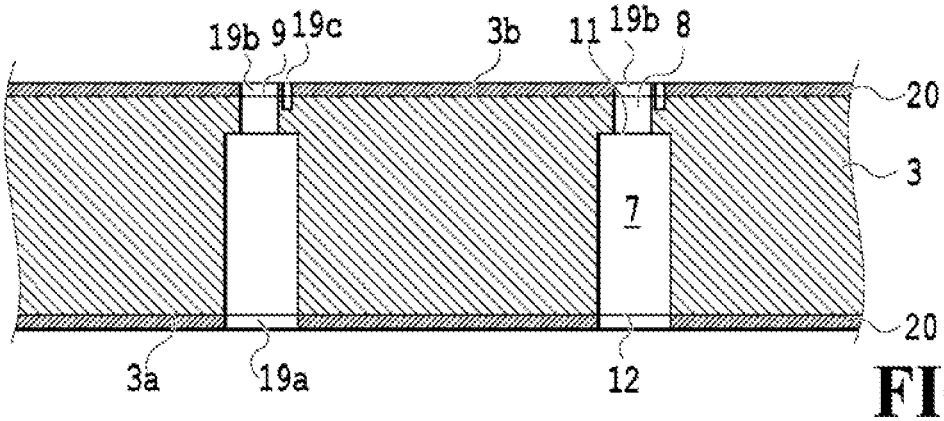

In this example, as a result of performing the etching processing, the depth of the second supply flow channel 7 formed in the second substrate 3 is about 450 μm, and the depth of the third supply flow channel 8 is about 150 μm. The depth of the groove portions 10 is about 40 μm. The opening width of the second supply flow channel 7 in the X direction is about 500 μm, and the opening width thereof in the Y direction is about 20000 μm. The opening width of the third supply flow channel 8 in the X direction is about 500 μm, and the opening width thereof in the Y direction is about 800 μm. The opening width of the groove portions 10 in the X direction is about 80 μm, and the opening width thereof in the Y direction is about 50 μm. Thereafter, as illustrated in FIG. 9D, the photoresist 21 no longer necessary is removed by an alkaline resist stripping solution. FIGS. 9C and 9D do not illustrate the inclined portion 13 formed in the third supply flow channel 8 for the sake of convenience.

Thereafter, as with the first embodiment, after the third supply flow channel opening 9 and the groove portions 10 are examined, processing of removing the thermal oxide films 20 is performed on the second substrate 3 that is determined as a non-defective item (see FIG. 6A). Then, as with the first embodiment, after the first substrate 2 and the second substrate 3 are adhered to each other (see FIG. 6B), the flow channel formation member 4 is formed on the first surface 2*a* of the first substrate 2 (see FIG. 6D). Thus, the liquid ejection head H illustrated in FIG. 1 is manufactured.

As described above, the groove portions 10 are formed close to the third supply flow channel opening 9 in the second substrate 3 of the liquid ejection head H manufactured by the method of manufacturing in this embodiment as well. Therefore, in the case where the third supply flow channel opening 9 is etched to exceed the tolerance, the third supply flow channel opening 9 communicates with the groove portions 10, the disintegration of the third supply flow channel opening 9 starting from the groove portions 10 is accelerated, and the third supply flow channel opening 9 is expanded largely. Accordingly, it is possible to easily and reliably determine the quality of the second substrate 3 only by observing the third supply flow channel opening 9 by visually checking or by using a low-powered microscope, and it is possible to reduce the time and cost required for the examination in this embodiment as well. Additionally, in the manufacturing method in this embodiment, the third supply flow channel 8 and the groove portions 10 are formed through different etching steps. Consequently, it is possible to individually control the opening width and the depth of the third supply flow channel 8 and the opening width and the depth of the groove portions 10.

Third Embodiment

Figure 10A:
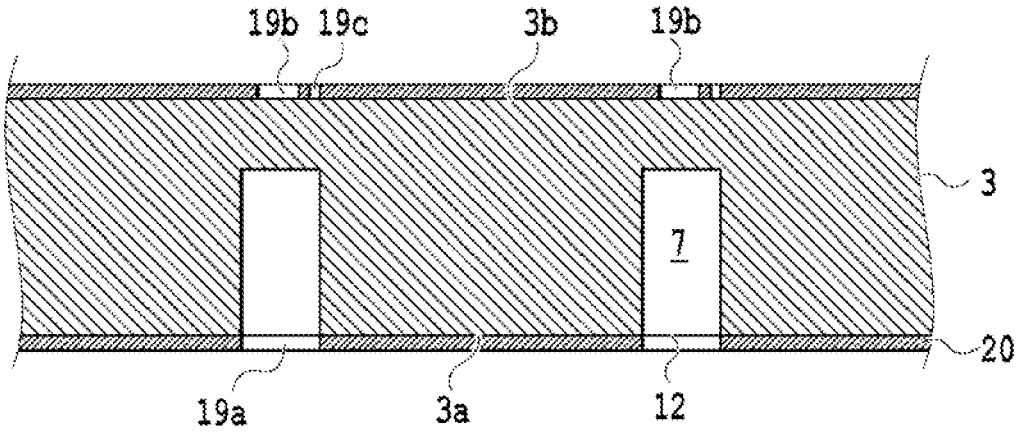
FIGS. 10A to 10C are schematic cross-sectional views illustrating a method of manufacturing a substrate for the liquid ejection head in a third embodiment.
Figure 10B:
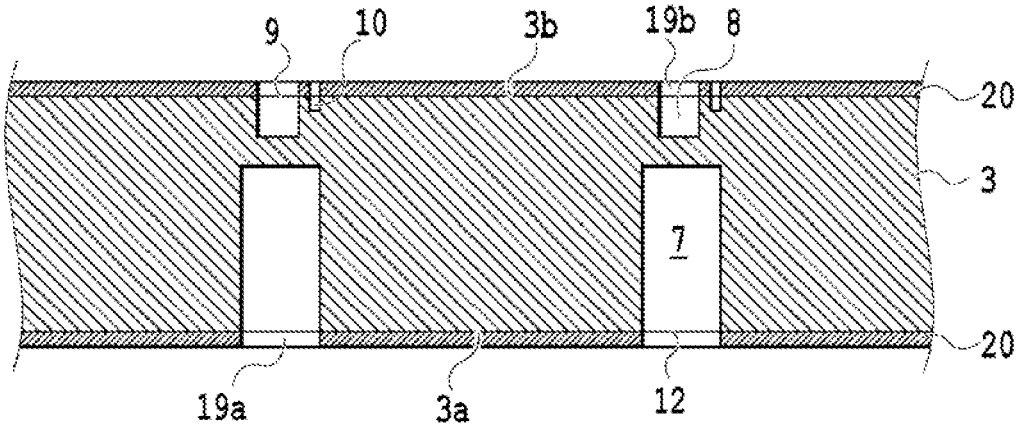
Figure 10C:
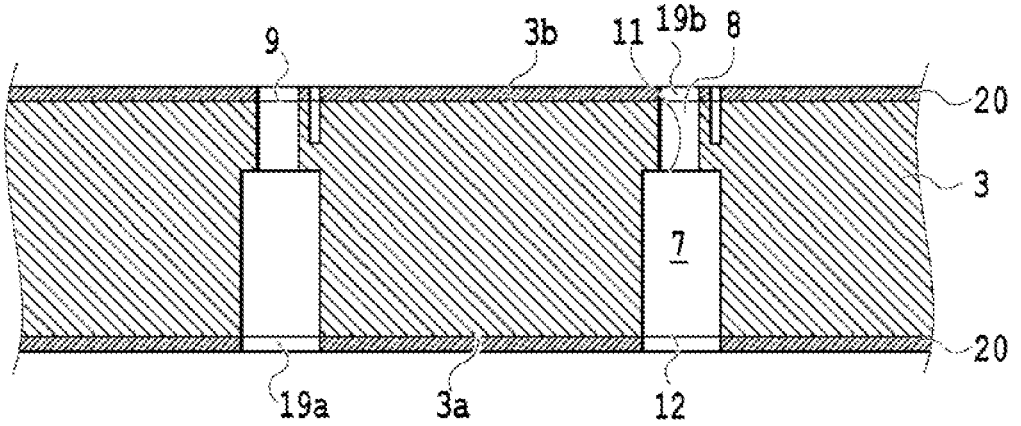

Next, a method of manufacturing a liquid ejection head in a third embodiment of the present disclosure is described with reference to FIGS. 10A to 10C. FIGS. 10A to 10C are drawings illustrating steps of forming the second supply flow channel 7, the third supply flow channel 8, and the groove portions 10 in the second substrate 3. In this embodiment, an example of manufacturing the second substrate 3 of the liquid ejection head H illustrated in FIG. 1 by a manufacturing method different from that in the first embodiment and the second embodiment is described. The descriptions of the creation of the first substrate 2 (see FIGS. 5A and 5B) are omitted in this embodiment as well since the method is similar to that in the first embodiment.

FIGS. 10A to 10C are drawings illustrating steps of forming the second supply flow channel 7, the third supply flow channel 8, and the groove portions 10 in the second substrate 3 in this embodiment. The manufacturing method in this embodiment is effective for a case where the groove portions 10 are formed while individually controlling the depth of the second supply flow channel 7 and the depth of the third supply flow channel 8.

First, as illustrated in FIG. 10A, the second substrate 3 including the films 20 resistant to etching on the two surfaces is prepared. As with the second embodiment, a silicon substrate having a crystal orientation of <110> having a thickness of about 600 μm is used as the second substrate 3. Thermal oxide films are used as the films 20. As with the first embodiment, on the thermal oxide films 20, the mask pattern 19*a* for forming the second supply flow channel 7, the mask pattern 19*b* for forming the third supply flow channel 8, and the mask pattern 19*c* for forming the groove portions 10 are formed.

First, as illustrated in FIG. 10A, the second supply flow channel 7 is formed by using the mask pattern 19*a* provided on the first surface 3*a* of the second substrate 3. In this example, a part of the second supply flow channel is processed by the Bosch process using reactive ion etching. The depth of the partially processed second supply flow channel 7 is about 400 μm. The opening width of the partially processed second supply flow channel 7 in the X direction is about 500 μm, and the opening width thereof in the Y direction is about 20000 μm.

Next, as illustrated in FIG. 10B, the third supply flow channel 8 and the groove portions 10 are formed in the second substrate 3 by using the mask patterns 19*b* and 19*c* provided on the second surface 3*b* of the second substrate 3. In this example, a part of the third supply flow channel 8 is processed by the Bosch process using reactive ion etching, and a part of the groove portions 10 is also formed concurrently. The depth of the partially processed third supply flow channel 8 is about 100 μm, the opening width thereof in the X direction is about 300 μm, and the opening width thereof in the Y direction is about 600 μm. The depth of the partially processed groove portions 10 is about 80 pam, the opening width thereof in the X direction is about 80 μm, and the opening width thereof in the Y direction is about 50 μm. After etching, the protection film (not illustrated) formed by the Bosch process is removed by hydrofluoroether.

Thereafter, as illustrated in FIG. 9C, wet etching (crystal anisotropic etching) is performed on the second substrate 3 such that the second supply flow channel 7 and the third supply flow channel 8 communicate with each other. With this etching, the second supply flow channel 7 and the third supply flow channel 8 communicate with each other in the communication portion 11. In this process, the depth of the second supply flow channel 7 is about 450 μm. The depth of the groove portions 10 is about 120 μm. The depth of the third supply flow channel 8 is about 150 μm. The opening width of the second supply flow channel 7 in the X direction is about 500 μm, and the opening width thereof in the Y direction is about 20000 μm. The opening width of the third supply flow channel 8 in the X direction is about 500 μm, and the opening width thereof in the Y direction is about 800 μm. The opening width of the groove portions 10 in the X direction is about 80 μm, and the opening width thereof in the Y direction is about 50 μm.

Ater performing the above-described etching processing, an examination to determine the quality of the second substrate 3 is carried out. Since the examination steps are similar to the method described in the first embodiment, the descriptions are omitted. Thereafter, the second substrate 3 that is determined as a non-defective item in the examination steps is adhered to the first substrate 2, and then the flow channel formation member 4 is formed on the first surface 2*a* of the first substrate 2; thus, the liquid ejection head H is completed.

As described above, the groove portions 10 are formed close to the third supply flow channel opening 9 in the second substrate 3 of the manufactured liquid ejection head H in this embodiment as well. Therefore, once the third supply flow channel opening 9 is etched to exceed the tolerance, the third supply flow channel opening 9 is expanded largely due to the communication with the groove portions 10. Consequently, it is possible to easily and reliably determine the quality of the second substrate in this embodiment as well. Additionally, in the manufacturing method in this embodiment, the adopted procedure is to individually form the second supply flow channel 7, the third supply flow channel 8, and the groove portions 10 to a predetermined depth by reactive ion etching, and then to allow the communication of the second supply flow channel 7 and the third supply flow channel 8 with each other by wet etching. Consequently, it is possible to form the groove portions 10 while individually controlling the depth of the second supply flow channel 7 and the depth of the third supply flow channel 8.

Other Embodiments

In the above-described embodiments and modification, there is described an example where the single groove portion 10X is formed in a region that is inside the third supply flow channel opening 9 and outside the second supply flow channel opening 12 in the X direction in the second surface 3*b* of the second substrate 3. However, multiple groove portions may be formed in a region in the X direction.

In the above-described embodiments and modification, the second substrate 3 is described as a substrate that includes a part of the substrate 1 for the head used in the liquid ejection head H. However, a silicon substrate having a configuration similar to that of the second substrate 3 disclosed in the above-described embodiments may be applied to a different device. That is, a substrate in which a first flow channel opened in the first surface of a silicon substrate having a crystal orientation of <110> and a second flow channel opened in the second surface of the silicon substrate opposite the first surface are formed to communicate with each other may be used as other than the substrate for the liquid ejection head. In this case, the first flow channel corresponds to the second supply flow channel 7 in the above-described embodiments, and the second flow channel corresponds to the third supply flow channel 8 in the above-described embodiment. In such a substrate, the opening width of the second flow channel is formed to an opening width narrower than the opening width of the first flow channel, and a groove portion shallower than the depth of the second flow channel is formed close to the second supply flow channel in a region that is inside the opening of the first flow channel and outside the opening of the second flow channel. With this configuration, as with the above-described embodiments, in a case where the second flow channel is formed to exceed the tolerance, it is possible to largely expand the opening of the second flow channel due to the communication with the groove portion. Consequently, it is possible to easily and reliably determine the quality of the substrate. As described above, the present disclosure is not only applicable to a substrate for a liquid ejection head but also widely applicable to a technique of precisely forming a flow channel through which liquid passes in a silicon substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-129242 filed Jul. 30, 2020, which is hereby incorporated by reference wherein in its entirety.

What is claimed is:

1. A substrate in which a first flow channel opened in a first surface of a silicon base material having a crystal orientation of <110> and a second flow channel opened in a second surface of the silicon base material opposite the first surface are formed to communicate with each other, wherein a width of the opening of the second flow channel is narrower than a width of the opening of the first flow channel, and a groove portion shallower than the depth of the second flow channel is formed close to the second flow channel in a region that is inside the opening of the first flow channel and outside the opening of the second flow channel in the second surface.

2. The substrate according to claim 1, wherein the groove portion is formed in a position in which the groove portion communicates with the opening of the second flow channel in a case where the opening of the second flow channel is formed to exceed a tolerance.

3. The substrate according to claim 1, wherein the first flow channel extend along a first direction, and the groove portion is formed close to the opening of the second flow channel in at least one of the first direction and a second direction orthogonal to the first direction.

4. The substrate according to claim 3, wherein a plurality of the groove portions are formed along at least one of the first direction and the second direction.

5. The substrate according to claim 3, wherein the opening of the second flow channel is in parallelogram, and the groove portion is formed outside an interior angle portion as an obtuse angle of the parallelogram formed by the opening of the second flow channel.

6. The substrate according to claim 3, wherein a width of an opening of the groove portion in the second direction is narrower than a width of the opening of the second flow channel in the second direction.

7. A substrate for a liquid ejection head, comprising:

a first substrate that includes a front surface provided with an element generating energy to eject liquid while a first supply flow channel supplying the liquid ejected by the element is formed penetrating the first substrate; and a second substrate that includes a silicon base material having a crystal orientation of <110> and is adhered to a back surface of the first substrate opposite the front surface, wherein in the second substrate, a second supply flow channel that is opened in a first surface of the second substrate and communicates with the first supply flow channel and a third supply flow channel that is opened in a second surface of the second substrate opposite the first surface are formed to communicate with each other, the third supply flow channel has an opening width narrower than an opening width of the second supply flow channel, and a groove portion shallower than a depth of the third supply flow channel is formed close to the third supply flow channel in a region that is inside the opening of the second supply flow channel and outside the opening of the third supply flow channel in the second surface of the second substrate.

8. The substrate for the liquid ejection head according to claim 7, wherein the groove portion is formed in a position in which the groove portion communicates with the opening of the third supply flow channel in a case where the opening of the third supply flow channel is formed to exceed a tolerance.

9. The substrate for the liquid ejection head according to claim 7, wherein the second supply flow channel extends along a first direction, and the groove portion is formed close to the opening of the third supply flow channel in at least one of the first direction and a second direction orthogonal to the first direction.

10. The substrate for the liquid ejection head according to claim 9, wherein a plurality of the groove portions are formed along at least one of the first direction and the second direction.

11. A liquid ejection head, comprising:

a substrate for the liquid ejection head including a first substrate that includes a front surface provided with an element generating energy to eject liquid while a first supply flow channel supplying the liquid ejected by the element is formed penetrating the first substrate, and a second substrate that includes a silicon base material having a crystal orientation of <110> and is adhered to a back surface of the first substrate opposite the front surface, wherein, in the second substrate, a second supply flow channel that is opened in a first surface of the second substrate and communicates with the first supply flow channel and a third supply flow channel that is opened in a second surface of the second substrate opposite the first surface are formed to communicate with each other, the third supply flow channel has an opening width narrower than an opening width of the second supply flow channel, and a groove portion shallower than a depth of the third supply flow channel is formed close to the third supply flow channel in a region that is inside the opening of the second supply flow channel and outside the opening of the third supply flow channel in the second surface of the second substrate; and a flow channel formation member that is formed on one side of the substrate for the liquid ejection head, wherein a pressure chamber that communicates with the first supply flow channel of the substrate for the liquid ejection head is formed between the substrate for the liquid ejection head and the flow channel formation member, and an ejection port that ejects the liquid supplied to the pressure chamber is formed in the flow channel formation member.

12. A method of manufacturing a substrate, comprising:

forming a first flow channel that is opened in a first surface of a silicon base material having a crystal orientation of <110>;

forming a second flow channel that has an opening narrower than an opening width of the opening of the first flow channel in a second surface of the silicon base material opposite the first surface so as to communicate with the first flow channel; and forming a groove portion that is shallower than a depth of the second flow channel close to the second flow channel in a region that is inside the opening of the first flow channel and outside the opening of the second flow channel in the second surface.

13. The method of manufacturing a substrate according to claim 12, further comprising:

examining a shape of the opening of the second flow channel formed in the silicon base material.

14. The method of manufacturing a substrate according to claim 12, wherein the forming of the first flow channel, the forming of the second flow channel, and the forming of the groove portion are performed concurrently.

15. The method of manufacturing a substrate according to claim 12, further comprising:

forming a mask that covers an opening of the groove portion, which is formed by the forming of the groove portion, and that communicates with the opening of the second flow channel on the second surface of the silicon base material, wherein after the forming of the mask, the forming of the first flow channel and the forming of the second flow channel are performed concurrently, and after the forming of the first flow channel and the forming of the second flow channel, the mask formed on the second surface is removed, and the forming of the groove portion is performed.

16. The method of manufacturing a substrate according to claim 12, wherein in the forming of the first flow channel and the forming of the second flow channel, first etching processing by which the first flow channel and the second flow channel are formed in the silicon base material to a position in which the first flow channel and the second flow channel do not communicate with each other is performed, and after the first etching processing, second etching processing by which the first flow channel and the second flow channel communicate with each other is performed.

17. The method of manufacturing a substrate according to claim 12, wherein the first flow channel, the second flow channel, and the groove portion are formed by anisotropic etching.

18. The method of manufacturing a substrate according to claim 12, wherein the communication of the first flow channel and the second flow channel with each other is achieved by crystal anisotropic etching.

19. The method of manufacturing a substrate according to claim 12, wherein the communication of the first flow channel and the second flow channel with each other is achieved by crystal anisotropic etching using a water solution of tetramethylammonium hydroxide.

* * * * *